US011313185B2

(12) United States Patent
Alshaarawi et al.

(10) Patent No.: US 11,313,185 B2
(45) Date of Patent: Apr. 26, 2022

(54) DIFFERENTIAL IRON ROUGHNECK

(71) Applicant: Saudi Arabian Oil Company, Dhahran (SA)

(72) Inventors: Amjad Alshaarawi, Dhahran (SA); Haytham H. Alhamed, Al Khobar (SA); Meshari M. Alshalan, Dhahran (SA); Abdulwahab Al-Johar, Dhahran (SA); Mohammad Saud Al-Badran, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 129 days.

(21) Appl. No.: 16/785,859

(22) Filed: Feb. 10, 2020

(65) Prior Publication Data

US 2021/0246741 A1 Aug. 12, 2021

(51) Int. Cl.
*E21B 19/16* (2006.01)

(52) U.S. Cl.
CPC ..... *E21B 19/168* (2013.01); *E21B 19/161* (2013.01); *E21B 19/163* (2013.01)

(58) Field of Classification Search
CPC ..... E21B 19/161; E21B 19/163; E21B 19/168
See application file for complete search history.

(56) References Cited

U.S. PATENT DOCUMENTS 4,494,424 A 1/1985 Bates
6,435,280 B1 * 8/2002 Van Wechem ..... E21B 19/16 166/377
6,591,916 B1 * 7/2003 Ayling ..... E21B 19/16 166/380
7,114,235 B2 10/2006 Jansch et al.
8,235,104 B1 8/2012 Sigmar et al.
8,783,137 B2 7/2014 Hamilton
9,016,386 B2 4/2015 Flusche
9,074,455 B2 7/2015 Pilgrim et al.
9,567,816 B2 2/2017 Bertelsen
9,657,539 B2 5/2017 Gupta et al.
2003/0221871 A1 12/2003 Hamilton et al.
2009/0211404 A1 8/2009 Pedersen et al.
(Continued)

FOREIGN PATENT DOCUMENTS

WO WO-2016/074060 A1 5/2016
WO WO-2021/161075 A1 8/2021

OTHER PUBLICATIONS

International Search Report for PCT/IB2020/052809, 7 pages (dated Nov. 26, 2020).

(Continued)

*Primary Examiner* — Christopher J Sebesta
(74) *Attorney, Agent, or Firm* — Choate, Hall & Stewart LLP; Charles E. Lyon; Peter A. Flynn

(57) ABSTRACT

A differential iron roughneck for making or breaking a pipe connection includes: at least one first gripping cylinder for delivering torque to a first pipe; at least one second gripping cylinder for delivering and receiving torque to and from a second pipe; and a differential gearbox including: a primary shaft delivering torque to the at least one first gripping cylinder; and a secondary shaft receiving torque from the at least one second gripping cylinder, where the primary shaft and the secondary shaft rotate at different speeds.

20 Claims, 4 Drawing Sheets

(56) References Cited

U.S. PATENT DOCUMENTS

| | | | | |
|---|---|---|---|---|
| 2010/0316322 | A1* | 12/2010 | Derrer | F16C 19/38<br>384/571 |
| 2013/0341042 | A1 | 12/2013 | Flusche | |
| 2014/0121048 | A1 | 5/2014 | Bowley et al. | |
| 2017/0314349 | A1* | 11/2017 | Bowley | E21B 19/16 |
| 2017/0314350 | A1 | 11/2017 | McClure | |
| 2018/0051527 | A1* | 2/2018 | Scekic | E21B 19/166 |
| 2018/0245410 | A1 | 8/2018 | Skjaerseth et al. | |
| 2019/0024466 | A1* | 1/2019 | Richardson | E21B 19/164 |

OTHER PUBLICATIONS

Invitation to Pay Additional Fees for PCT/IB20/52809, 11 pages (dated Oct. 5, 2020).
Written Opinion for PCT/IB2020/052809, 12 pages (dated Nov. 26, 2020).
International Preliminary Examining Authority Written Opinion for PCT/IB2020/052809, 8 pages (dated May 17, 2021).

* cited by examiner

DIFFERENTIAL IRON ROUGHNECK

FIELD

The subject matter described herein relates to systems and methods for making and breaking pipe connections of a drilling string.

BACKGROUND

Modern drilling systems commonly employ Top-Drive Systems (TDS), which are mechanically coupled to the top of a drilling string. In operation, the TDS provides rotation and vertically downward motion of the drilling string. When the TDS hits the bottom point and cannot move down any further (for example, because the drilling string is almost entirely below the rig floor) an additional drill pipe must be connected to the drilling string. The drilling string is "hung" at the rig floor level on a device called a rotary table using slips (which tightly clamp around the top drill pipe and mechanically engage with the rotary table). An additional length of drill pipe may then be screwed into the top end of the hung drilling string. The TDS is then engaged on the top of the newly-added drill pipe. The drilling cycle may then be restarted.

Top-Drive Systems (TDS) are designed such that it is necessary for the drilling string to temporarily stop the rotation and circulation actions while the new drill pipe is added to the drilling string. While the drilling string and circulation systems are temporarily stopped, the drilling string can become stuck, leading to delays as well as equipment damage. A drilling string stuck down-hole can cost upwards of $1 million to resolve, and result in more than two weeks of lost time.

SUMMARY

The present disclosed embodiments relate to systems and methods for making and breaking pipe connections of a drilling string while the drilling string is continually rotating, using a differential iron roughneck (that is, an iron roughneck that includes a differential gearbox).

In one aspect of the present invention, a differential iron roughneck for making or breaking a pipe connection includes: at least one first gripping cylinder for delivering torque to a first pipe; at least one second gripping cylinder for delivering and receiving torque to and from a second pipe; and a differential gearbox including: a primary shaft delivering torque to the at least one first gripping cylinder; and a secondary shaft receiving torque from the at least one second gripping cylinder, where the primary shaft and the secondary shaft rotate at different speeds.

In some embodiments, the differential iron roughneck may include: at least one first balance cylinder for contacting the first pipe, the at least one first balance cylinder including a first centerline axis; and at least one second balance cylinder for contacting the second pipe and including a second centerline axis, where the first balance cylinder and the second balance cylinder freely spin about the respective first and second centerline axes.

In some embodiments, the first balance cylinder exerts a first force on the first pipe which balances a second force exerted by the first gripping cylinder on the first pipe.

In some embodiments, the differential iron roughneck may include: at least two first gripping cylinders; and at least two second gripping cylinders.

In some embodiments, the differential iron roughneck may include: at least two first balance cylinders; and at least two second balance cylinders.

In some embodiments, the differential gearbox further includes: at least one drive shaft introducing a driving torque into the differential gearbox for rotating both the primary shaft and the secondary shaft.

In some embodiments, the differential iron roughneck may include: a driven portion including: a first pair of arms extending laterally and including a first axle extending therebetween, the first axle concentrically disposed within the first gripping cylinder; and a second pair of arms extending laterally and including a second axle extending therebetween, the second axle concentrically disposed within the second gripping cylinder.

In some embodiments, the differential iron roughneck may include: a balance portion including: a first pair of balance arms extending laterally and including a first balance axle extending therebetween, the first balance axle concentrically disposed within the first balance cylinder; and a second pair of balance arms extending laterally and including a second balance axle extending therebetween, the second balance axle concentrically disposed within the second balance cylinder.

In some embodiments, the differential iron roughneck may include: a first roller chain and/or a first belt coupling the first gripping cylinder to the primary shaft; and a second roller chain and/or a second belt coupling the second gripping cylinder to the secondary shaft.

In some embodiments, the first gripping cylinder, the second gripping cylinder, the first balance cylinder, and/or the second balance cylinder further includes at least one gripping surface.

In another aspect of the present invention, a system for making or breaking a pipe connection includes: a first pipe; a second pipe; and a differential iron roughneck including: at least one first gripping cylinder for delivering torque to the first pipe; at least one second gripping cylinder for delivering torque to a second pipe; and a differential gearbox coupled to each of the first gripping cylinder and the second gripping cylinder, where the differential gearbox rotates the first gripping cylinder and the second gripping cylinder at different speeds.

In some embodiments, the first pipe is the top pipe of a drill string, and the second pipe includes a drill pipe to be added to the drill string.

In some embodiments, the first pipe includes a box portion including a female threading, and the second pipe includes a pin portion including male threading for engaging with the female threading of the box portion during at least one of making the pipe connection and breaking the pipe connection.

In some embodiments, the system includes a rotary table coupled to the drill string.

In some embodiments, the system includes a swivel coupled to the second pipe, vertically supporting the second pipe, and allowing the second pipe to rotate.

In some embodiments, the drill string includes a drill bit.

In another aspect of the present invention, a method of making a pipe connection includes: providing a differential iron roughneck including at least one differential gearbox including a primary shaft and a secondary shaft; engaging a drill string with the differential iron roughneck; and engaging a second pipe with the differential iron roughneck, the second pipe to be added to the drill string, where the primary shaft is coupled to the drill string and rotates the drill string, and where the secondary shaft is coupled to the second pipe and rotates the second pipe faster than the drill string.

In some embodiments, the method may include aligning the second pipe with the drill string.

In some embodiments, the method may include engaging at least one female thread disposed in the drill string with at least one male thread disposed in the second pipe.

In some embodiments, the method may include disengaging the drill string from a rotary table.

Throughout the description, where an apparatus, systems or compositions are described as having, including, or comprising specific components, or where methods are described as having, including, or comprising specific steps, it is contemplated that, additionally, there are systems, apparatuses or compositions of the present invention that consist essentially of, or consist of, the recited components, and that there are methods according to the present invention that consist essentially of, or consist of, the recited processing steps.

It should be understood that the order of steps or order for performing certain action is immaterial as long as the invention remains operable. Moreover, two or more steps or actions may be conducted simultaneously.

The following description is for illustration and exemplification of the disclosure only, and is not intended to limit the invention to the specific embodiments described.

The mention herein of any publication, for example, in the Background section, is not an admission that the publication serves as prior art with respect to any of the present claims. The Background section is presented for purposes of clarity and is not meant as a description of prior art with respect to any claim.

BRIEF DESCRIPTION OF THE DRAWINGS

A full and enabling disclosure of the present disclosed embodiments, including the best mode thereof, directed to one of ordinary skill in the art, is set forth in the specification, which makes reference to the appended figures, in which:

FIG. 8 illustrates a flow chart representation of a method of making and breaking a pipe connection, in accordance with aspects of the present disclosed embodiments.

DESCRIPTION OF CERTAIN EMBODIMENTS OF THE INVENTION

Figure 1:
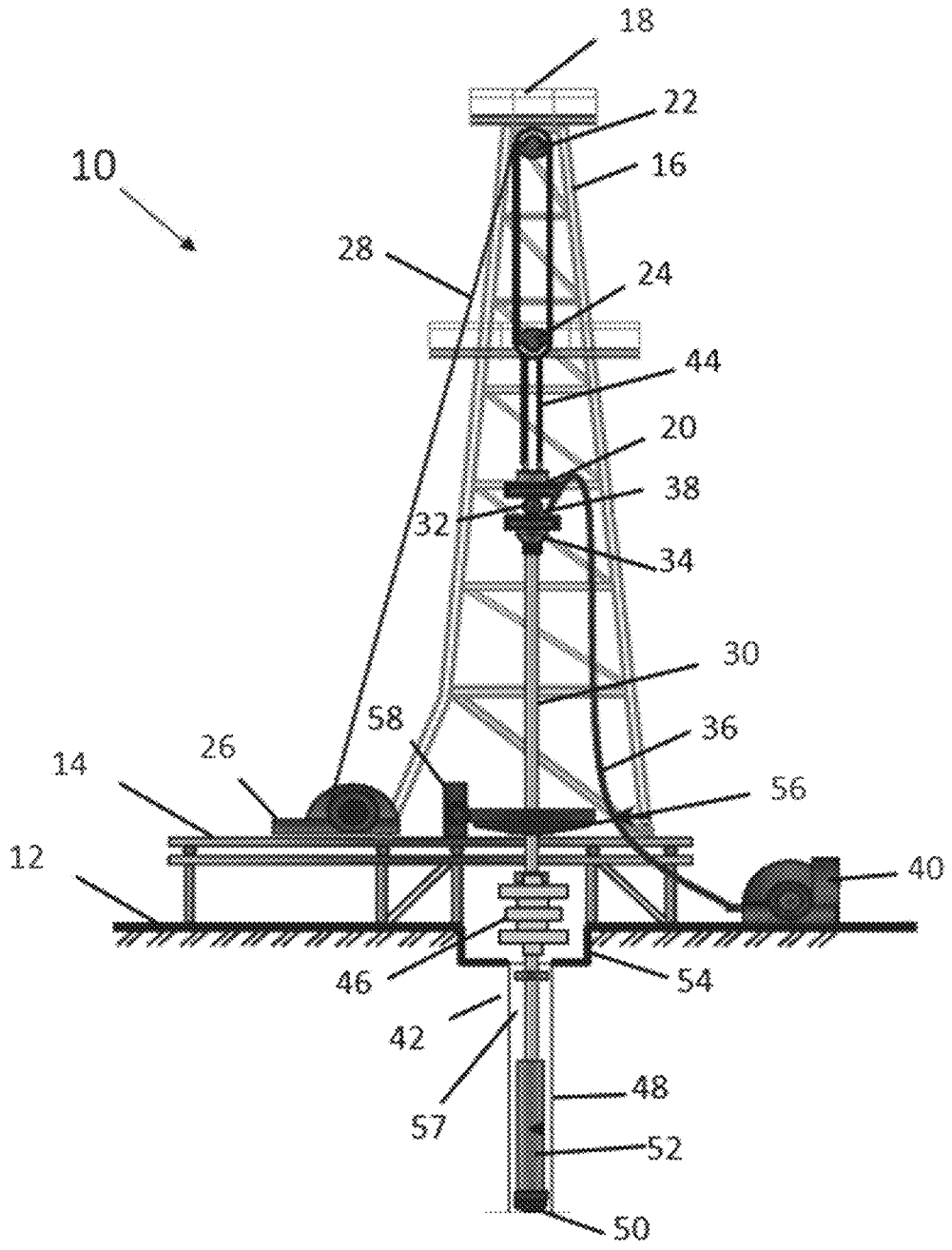
FIG. 1 illustrates an exemplary depiction of a Top-Drive System (TDS)

Reference will now be made in detail to the present disclosed embodiments, one or more examples of which are illustrated in the accompanying drawings. The detailed description uses numerical and/or letter designations to refer to features in the drawings. Like or similar designations in the drawings and description have been used to refer to like or similar parts of the present embodiments.

The present disclosure provides systems and methods for making and breaking pipe connections using a differential iron roughneck, while allowing the system remain in motion (that is, rotating).

FIG. 1 illustrates an exemplary rig with a Top Drive System (TDS) 10, including a rig floor 14, elevated above the ground 12. Extending vertically upward from the rig floor 14 is a derrick 16 which includes a framework for supporting the TDS 10. A crown block 18 is disposed at a fixed location at the top of the derrick 16, while a traveling block 20 is disposed beneath the crown block 18. The traveling block 20 may translate vertically up and down the derrick 16 via at least one top one pulley 22 coupled to or proximate the crown block 18, and at least one bottom pulley 24 coupled to or proximate the travelling block 20. Bearings, guides, an applied load, and/or other mechanisms (not shown) keep the traveling block 20 aligned as it translates up and down the derrick 16. The traveling block 20 may be coupled to the bottom pulley 24 via a hoist 44 (which itself may be a metallic wire-rope) or via other suitable mechanisms. A drawworks 26, which works like a winch, may be coupled to the rig floor 14 and used as a hoisting mechanism for raising and lowering the travelling block 20 via a drill line 28. The drill line 28, which may be a metallic wire-rope, may wind around each of the top and bottom pulleys 22, 24 anywhere from about 2 to about 20 times.

Referring still to FIG. 1, the traveling block 20 be connected to a top drill pipe known as the new pipe 30 via one or more lifting hooks 32 and swivel 34, which allows the new pipe 30 to rotate freely while being supported by the lifting hooks 32 without the lifting hooks 32 having to also rotate. The new pipe 30 connects to a drill string 42 at the rig floor 14. A male-threaded portion at the bottom end of the new pipe 30 known as the pin 106 (shown in FIG. 2) is screwed into a female-threaded portion at the top of the drill string 42 known as the box 108 (shown in FIG. 2). A mud pump 40 may be positioned on the ground 12 or on the rig floor 14 and may be used to pump mud, slurries or drilling fluid through a mud hose 36 to a drill string inlet 38 located at the top of the new pipe 30. Mud, slurries or drilling fluid then travels vertically downward through the center of the drill string 42 and out at the drill bit 50, which is coupled to the bottom of the drill string 42 via a drill collar 52. The mud, slurry, or drilling fluid then travels vertically upward within an annulus 47 between the center of the drill string 42 and the drill string casing 48 (bringing with it any rock fragments and cuttings from the drilling process), and exits the casing at the borehole opening 54.

Still referring to FIG. 1, the rig 10 may also include a blowout preventer 46 located at the borehole opening 54 (between the top of the borehole 54 and the bottom of the rig floor 14), as well as a rotary table 56 (or turntable) for rotating the drill string 42. An iron roughneck 58 may also be located on the rig floor 14. In operation, the iron roughneck 58 is used to add or torque up a new drill pipe (for example, the new pipe 30) to the drill string 42 once the top of the previous new pipe 30 is at or proximate the rig floor 14. A bottom portion of the iron roughneck 58 grips the top of the drill string 42, firmly holding it motionless while a top portion of the iron roughneck 58 grips the bottom of the new pipe 30 and screws it into the drill string 42. The TDS 10 of FIG. 1 may include other components which are not shown such a motors, generators, and power supplies for powering the drawworks 26, mud pump 40, iron roughneck 58, and rotary table 56. The rig 10 may also include mud and water supply lines and supply tanks (not shown) as well as other components. The iron roughneck 58 may screw the new pipe 30 into the drill string 42. Due to the limited range of motion, the top portion of the iron roughneck 58 may de-grip, rotate, re-grip, and reapply torque several times in order to deliver the required make-up torque, thereby ensuring that a robust connection is established between the new pipe 30 and the drill string 42. This may be a timely process, and because it entails firmly holding the drill string 42 motionless, the system 10 risks having the drill string 42 get stuck.

Figure 2:
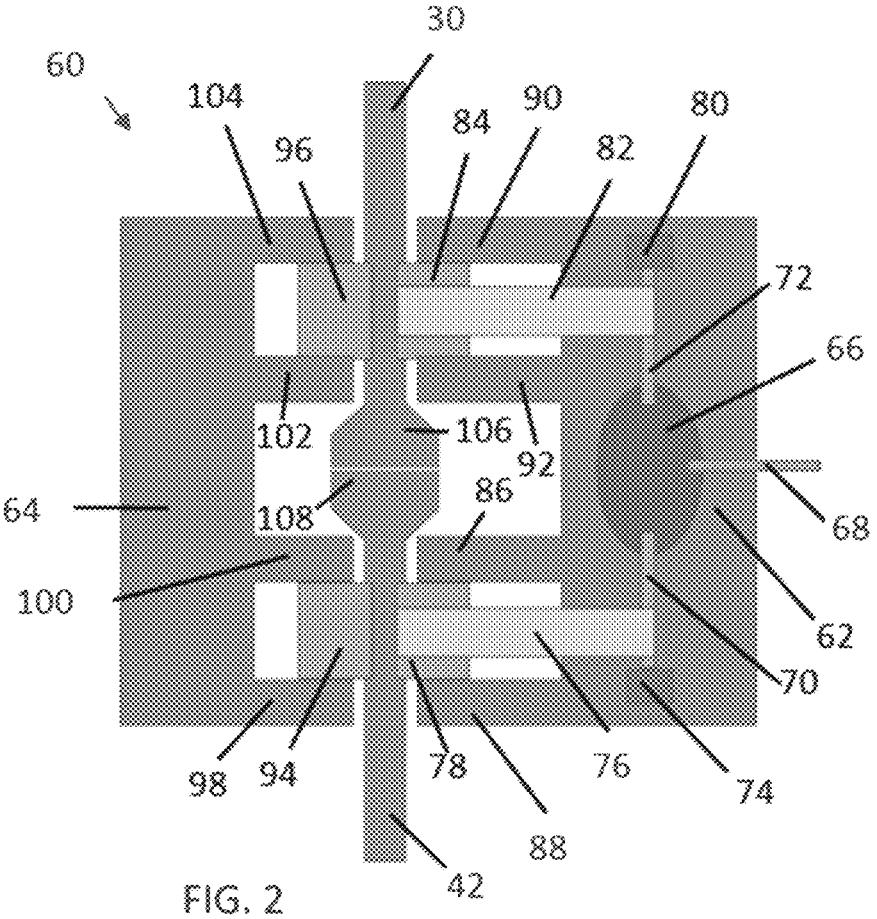
FIG. 2 illustrates a side view depiction of a differential roughneck, according to the present embodiments.

FIG. 2 illustrates a side view of a differential iron roughneck 60 according to the present disclosed embodiments. The differential roughneck 60 includes a driven portion 62 and a balance portion 64. The driven portion 62 generates torque for spinning the new pipe 30 with respect to the drive string 42, while the balance portion 64 includes multiple freely-spinning gripping cylinders 94, 96 for balancing the horizontal force applied by the driven portion 62. The driven portion 62 includes a differential gearbox 66 which is connected to a drive shaft 68 which provides a source of torque (or mechanical power) to the differential gearbox 66. The torque is transferred within the differential gearbox 66 to a secondary shaft 72.

Referring still to FIG. 2, the differential gearbox 66 may include several internal configurations, including one or more embodiments in which the drive shaft 68 transfers power to a large ring gear (not shown) which is coupled to a cage or housing (not shown). The cage (or housing) rotates with the large ring gear. The cage houses one or more pinion gears (not shown) and one or more side gears (not shown). For example, in one embodiment, the differential gearbox 66 may include two pinion gears opposing each other, each of the pinion gears interfacing with two side gears, which are also opposing each other. The pinion gears are each free to rotate within the housing while a first side gear of the two side gears may be coupled to the primary shaft 70, and a second side gear of the two side gears may be coupled to the secondary shaft 72. As such, the rotations of each of the primary and secondary shafts 70, 72 is dictated by a combination of the rotation of the entire cage, as well as the rotations of the pinion and side gears within the cage. Differential rotational speeds of the primary and secondary shafts 70, 72 may occur if different external torques are applied to them, with greater differential rotational speeds resulting from lower applied external torques. The differential gearbox 66 may include any tri-axial differential gearbox that allows controllable, relative rotation between the primary and secondary shafts 70, 72.

Still referring to FIG. 2, the primary shaft 70 may be disposed between the differential gearbox 66 and a primary bearing 74, while the secondary shaft 70 may be disposed between the differential gearbox 66 and a secondary bearing 80. Each of the primary and secondary bearings 74, 80 (as well as other bearings in the present disclosure) may include ball bearings, roller bearings, mounted bearings, linear bearings, slide bearings, jewel bearings, or frictionless bearings, as well as combinations thereof, as well as other bearings capable of withstanding the radial loading resulting from the gripping action. Each of the primary and secondary shafts 70, 72 may drive respective primary and secondary drive chains 76, 82, which in turn may drive primary and secondary gripping cylinders 78, 84. The primary gripping cylinders 78 are used to transfer rotation from the drill string 42 to the differential gear box 66 and the secondary gripping cylinders 84 are used to drive the new pipe 30. For example, each of the primary and secondary drive chains 76, 82 wrap around the primary and secondary gripping cylinders 78, 84 causing them to spin due to the contact friction between the gripping cylinders 78, 84 and the drive chains 76, 82. Each of gripping cylinders 78, 84 have interfacing surfaces with the drill string 42 or the new pipe 30, the interfacing surfaces including at least one gripping mechanism. In one embodiment, the gripping mechanism may be a gripping surface (shown in FIGS. 4 and 5). In another embodiment, the gripping mechanism may be roller chains with interfacing teeth (shown in FIGS. 6 and 7). In another embodiment, the gripping mechanism may one or more belts with a roughened or frictional surface for dripping (shown in FIG. 5). The primary gripping cylinder 78 may be disposed between a top primary arm 86 and a bottom primary arm 88 such that an axle (not shown) runs through the centerline of the primary gripping cylinder 78, the axle being anchored into top primary arm 86 and the bottom primary arm 88 thereby allowing the primary gripping cylinder 78 to rotate about it. Similarly, the secondary gripping cylinder 84 may be disposed between a top secondary arm 90 and a bottom secondary arm 92 such that an axle (not shown) runs through the centerline of the secondary gripping cylinder 84, the axle being anchored into top secondary arm 90 and the bottom secondary arm 92 thereby allowing the secondary gripping cylinder 84 to rotate about it.

Referring still to FIG. 2, the balance portion 64 includes similar structures to that of the driven portion 62, with the exception that the balance portion is not driven via a differential gearbox 66. For example, a primary balance cylinder 94 is disposed between first and second balancing arms 98, 100 while a secondary balance cylinder 96 is disposed between third and fourth balancing arms 102, 104. Each of the primary and secondary balance cylinders 94, 96 may freely rotate about a central axle (not shown) and helps to ensure that the new pipe 30 and the drive string 42 remain in alignment during connection and disconnection. In one embodiment, each of the primary and secondary gripping cylinders 78, 84, and each of the primary and secondary balancing cylinders 94, 96 includes two cylinders (for a total of eight). In another embodiment, each of the primary and secondary gripping cylinders 78, 84, and each of the primary and secondary balancing cylinders 94, 96 includes three cylinders (for a total of twelve). In another embodiment, each of the primary and secondary gripping cylinders 78, 84, and each of the primary and secondary balancing cylinders 94, 96 includes four or more cylinders. In another embodiment, each of the primary and secondary gripping cylinders 78, 84, and each of the primary and secondary balancing cylinders 94, 96 includes from about one cylinder to about six cylinders. In some embodiments, at least two of the cylinders may include different diameters. In some embodiments, there may be a different number of cylinders on one side (for example on the driven portion) than on the other side (for example on the balancing portion).

Still referring to FIG. 2, each of the components may be composed of any suitable material that includes sufficient strength. For example, the materials that each of the components of the differential iron roughneck 60 may be composed of may include (but are not limited to) steel, stainless steel, carbon steel, austenitic steel, wrought iron, composite materials (including ceramic matrix composites, polymer matric composites and metal matrix composites), super-alloys, nickel-based super-alloys, titanium aluminide, iron, as well as other materials. The differential iron roughneck 60 may include motors, generators, or power supplies for providing torque to the drive shaft. In addition, the differential iron roughneck 60 may be integrated into the rotary table 56 of existing rigs 10. A pin 106 at the bottom of the new pipe 30 may include male threads such that it may engage with female threads of box 108 at the top of the drive string 42. At each end of each segment of drill pipe (that is, where pin 106 and box 108 are disposed within the respective new pipe 30 and drill string 42) the diameter of the pipe may be increased to allow for inclusion of the pipe thread features while still ensuring sufficient cross-sectional area to maintain the required torsional, tensional, and compressive pipe strengths.

Referring still to FIG. 2, the driven and balancing portions 62, 64 may each be designed such that the four arms 86, 88, 90, 92 of the driven portion 62 extend toward the balance portion 64 and the four arms of the balance portion 98, 100, 102, 104 extend toward the driven portion 62. The bottom two arms of each of the driven and balance portion 62, 64 (for example, arms 86, 88, 98, 100) each support the respective bottom gripping and balance cylinders 78, 94 which engage the drill string 42. Similarly, the top two arms of each of the driven and balance portion 62, 64 (for example, arms 90, 92, 102, 104) each support the respective top gripping and balance cylinders 84, 96 which engage the new pipe 30. The top pairs of arms and the bottom pairs of arms are vertically spaced apart such that the increased diameter of the new pipe 30 and the drill string 42 at the pin and box portions 106, 108 may be accommodated and fit in the space created between the top and bottom pairs of arms. Because FIG. 2 is a side view, each of the gripping or balancing cylinders 78, 84, 94, 96 may include multiple cylinders with the second, third, fourth (et cetera) cylinder of each located "behind" the front cylinder (that is, behind or "into the page" in the view of FIG. 2), and therefore out of view in FIG. 2. Each of the second, third, fourth (et cetera) cylinders may be held in place by the arms 86, 88, 90, 92, 98, 100, 102, 104 illustrated in FIG. 2. In other embodiments, each of the second, third, fourth (et cetera) cylinders may be held in place by a second, third, fourth (et cetera) pair of arms located behind the arms 86, 88, 90, 92, 98, 100, 102, 104 illustrated in FIG. 2.

In operation, when it is time to add another drill pipe (new pipe 30) to the assembly, the drive string 42 is hung on the rotary table 56 while it continues to be rotated by the rotary table 56. The new pipe 30 is brought close to the drill string 42 such that the pin 106 at the bottom of the new pipe 30 is aligned with the box 108 at the top of the drill string 42. The driven portion 62 and the balance portion 64 are then brought close to the new pipe 30 and drive string 42, which may be executed using a hydraulic piston (not shown) mechanically coupling the driven portion 62 to the balance portion 64. For example, when the hydraulic piston is extended, the differential roughneck 60 is not engaged on the drill pipe 42 and new pipe 30. As the hydraulic piston retracts, the arms 86, 88, 90, 92, 98, 100, 102, 104 bring the gripping and balance cylinders 78, 84, 94, 96 close to the drill pipe 42 and the new pipe 30, such that they may contact and engage the drill pipe 42 and new pipe 30. The gripping and balance cylinders 78, 84, 94, 96 then engage the new pipe 30 and the drive string 42. Additional torque is then introduced to the differential gearbox 66 via the drive shaft 68. Torque provided by the rotary table 56 drives the rotation of the drill pipe 42, and the additional torque provided through the drive shaft 68 drives the relative rotation of the new pipe 30 with respect to the drill pipe 42. As a result, the new pipe 30 will be screwed into the drill string 42 via the pin 106 and box 108, while both the drill string 42 and the new pipe 30 are rotating. Stated otherwise, even though the new pipe 30 and the drill string 42 are rotating in the same direction, the faster rotational speed of the new pipe 30 will allow it to "catch-up" to the drill string 42, thereby allowing the male threads of the pin 106 to engage the female threads of the box 108.

In some embodiments, a DC motor may be used to power the drive shaft 68, and as the new pipe 30 begins to engage the drill string 42, the new pipe 30 will naturally begin to slow down as resistive torque builds up. Once a make-up torque has been achieved, the new pipe 30 will be robustly engaged within the drill string 42 and the two will be spinning at the same speed, both still being spun via the rotary table 56. At this point, the new pipe 30 has become part of the drill string 42 and drilling operations can resume. The present embodiments thus allow the drill string 42 to continually spin (and to achieve continuous rotation) throughout the entire make-up process. After the make-up process is complete, the Top-Drive System (TDS) 60 may continue to be operated normally. The differential iron roughneck 60 illustrated in FIG. 2 (as well as FIGS. 3-7) may be used in connection with the system 10 of FIG. 1, as well as other TDS and drilling systems. Stated otherwise, the differential iron roughneck 60 according to the present disclosure may be used in any system that employs a conventional iron roughneck (or other type of iron roughneck). In some embodiments, while the new pipe 30 is being added to the drill string 42, the differential iron roughneck 60 begins spinning, then engages each of the new pipe 30 and the drill string 42. In other embodiments while the new pipe 30 is being added to the drill string 42, the differential iron roughneck 60 first engages with the new pipe 30 and drill string 42, and then begins spinning. In other embodiments, the differential iron roughneck 60 simultaneously (or concurrently) engages both the new pipe 30 and drill string 42 as it beings to spin.

During the break-up process (that is, in order to disconnect the new pipe 30 (or top drill pipe) from the drill string 42), rotation of the drill string 42 can similarly be maintained. To break the new pipe 30 off of the drill string 42, both the new pipe 30 and drill string 42 are engaged by the gripping and balance cylinders 78, 84, 94, 96 of the differential iron roughneck 60 as described above. The rotary table 56 will continue to rotate the entire drill string 42 in a forward direction (that is, in the same direction it has been rotating in throughout the drilling and make-up processes). A resistive torque may then be applied to the new pipe 30. As the resistive torque acting on the new pipe 30 exceeds a break-up torque, the new pipe 30 will begin to disengage from the drill string 42. The new pipe 30 and the drill string 42 will eventually become completely disengaged from each other while the drill string 42 continues to be spun via the rotary table 56. In other embodiments, the new pipe 30 may be disconnected from the drill string 42 by engaging the rotary table 56 on the drill string 42, rotating the rotary table 56 in the standard direction (i.e., in the drilling direction), and then running the differential roughneck 60 in reverse. This will provide a first torque on the new pipe 30 oppositely oriented from a second torque resulting from the rotary table 56 acting on the drill string 42.

Figure 3:
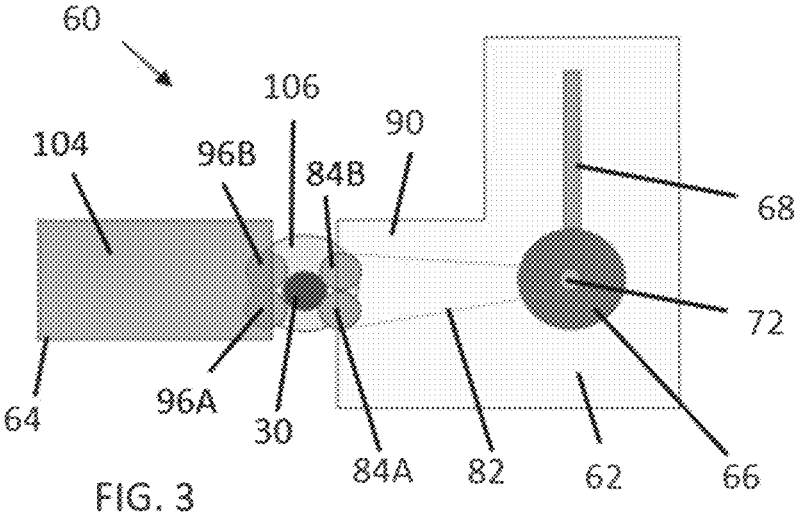
FIG. 3 illustrates a top view depiction of a differential roughneck, according to the present embodiments.

FIG. 3 illustrates a top view of the differential iron roughneck 60 according to aspects of the present disclosed embodiments. The differential iron roughneck 60 includes a driven portion 62 including the differential gearbox 66, the drive shaft 68, the secondary shaft 72, the drive chain 82 and the top secondary arm 90. Similarly, the differential iron roughneck 60 includes a balance portion 64 including the third balance arm 104. In the top view of FIG. 3, first and second secondary gripping cylinders 84A, 84B, as well as first and second secondary balance cylinders 96A, 96B are visible. The primary shaft 70, primary cylinders 78, 94 and other features (such as the arms 86, 88, 92, 98, 100, 102) are also present in the embodiment of FIG. 3. However, those features are not visible in the top view depicted in FIG. 3. Also visible in FIG. 3 are the new pipe 30 and the pin 106. In the embodiment of FIG. 3, the drive shaft 68 is oriented at approximately a right angle to the drive chain 82 (+/− from about 5 to about 10 degrees), which is a different orientation than the embodiment of FIG. 2. In other embodiments, the drive shaft 68 may be oriented at other angles (including angles other than right angles relative to the alignment of the drive chain 82 as well as relative to the alignment of the primary and secondary shafts 70, 72). In each of the present disclosed embodiments, the drive chains 76, 82 may include belts, linkages, treads, ropes and other mechanisms for spinning the gripping and balance cylinders 78, 84, 94, 98. The drive chains 76, 82 and other mechanisms described above may include notches, cogs, spokes, grooves, gears, spurs, sprockets, divots, teeth, bumps, trenches, roughened surfaces, grip surfaces, and other mechanisms for creating a contact or frictional connection between the drive chains 76, 82 and the gripping cylinders 78, 84, as well as between all of the cylinders 78, 84, 94, 98 and the drill pipes (that is, the new pipe 30 and the drill string 42).

Figure 4:
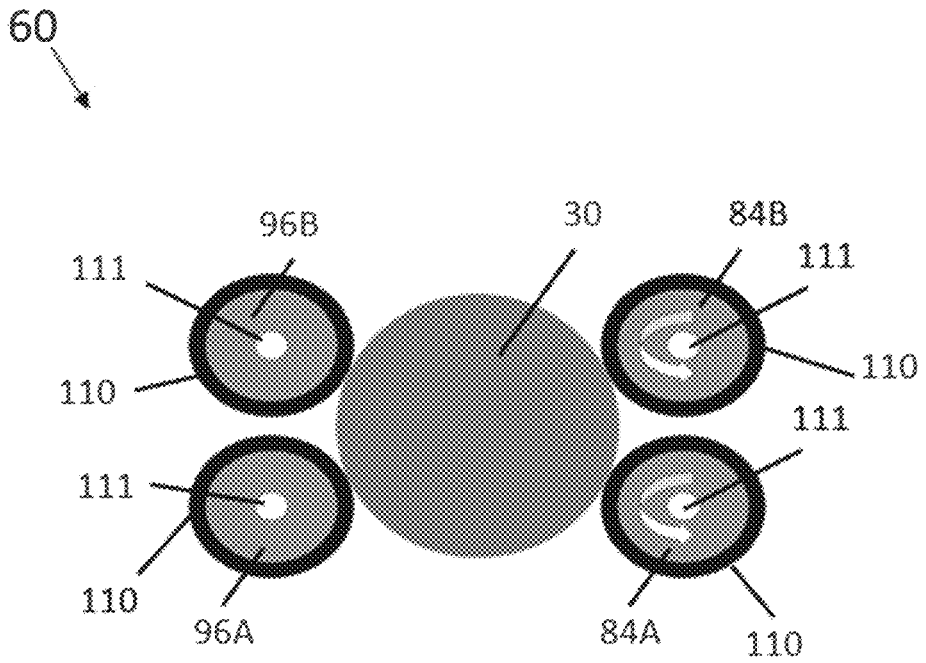
FIG. 4 illustrates a top view depiction of a differential roughneck, according to the present embodiments.

FIG. 4 illustrates a top view of a portion of the differential iron roughneck 60 according to aspects of the present disclosed embodiments. The differential iron roughneck 60 includes first and second gripping cylinders 84A, 84B (which are driven via the secondary shaft 72 and differential gearbox 66, shown in FIG. 2), as well as first and second balancing cylinders 96A, 96B, all disposed around (and interfacing with) the new pipe 30 (or drill pipe being attached to the drill string 42 (shown in FIG. 2)). In the embodiment of FIG. 4, each of the gripping and balancing cylinders 84A, 84B, 96A, 96B includes a gripping surface 110 disposed around the curved outer surface for gripping the new pipe 30. The gripping surface 110 may be composed of a hardened rubber, softened rubber, polymers, thermoplastics, composite materials, metallic materials, ceramic materials, as well as other suitable materials. In addition, the gripping surface 110 may be composed of the same material as the underlying substrate. For example, the gripping surface 110 may be a roughened portion of the substrate that has been made more abrasive. The entire outer surface of the various substrates may act as gripping surfaces 110. In other embodiments, only a portion of the substrate will act as a gripping surface 110 (for example, only the portions interfacing with one or more contact surfaces of a neighboring cylinder or drill pipe). In other embodiments, the gripping surface 110 may include inserts that are inserted into the cylinder and are capable of providing enough friction to allow gripping of the cylinders 84A, 84B to occur. In other embodiments, the gripping surface 110 may include drilling slips inserts. In the embodiment of FIG. 4, the cylinder axes 111 are also visible. The cylinder axes 111 are aligned with the centerline of each of the gripping and balancing cylinders 84A, 84B, 96A, 96B, allowing for rotation of each about the respective cylinder axis 111.

Figure 5:
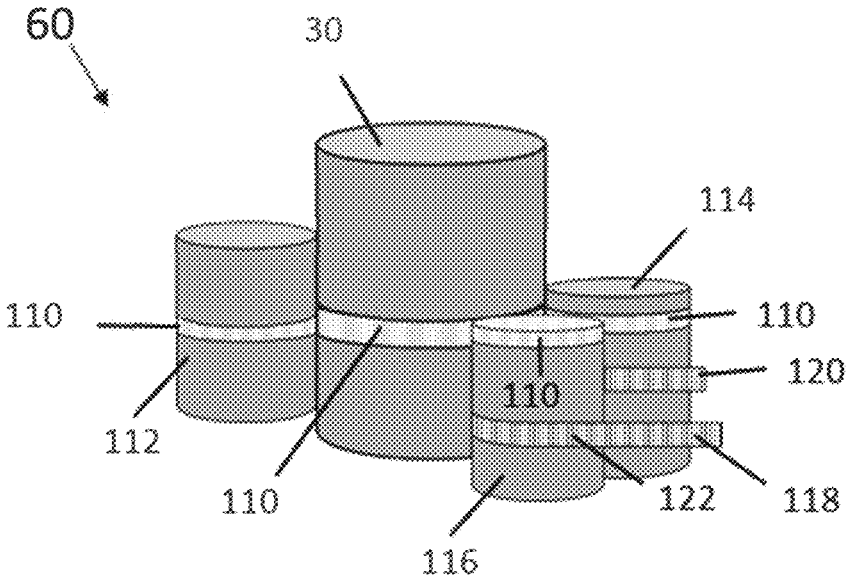
FIG. 5 illustrates a prespective view depiction of a differential roughneck, according to the present embodiments.

FIG. 5 illustrates a perspective view of a portion of an exemplary differential iron roughneck 60 including a new pipe 30 surrounded by a number of cylinders 112, 114, 116. The new pipe 30 along with the cylinders 112, 114, 116 each include a gripping surface 110 for aiding in the frictional or contact connection with interfacing surfaces. A first cylinder 112 may include a gripping surface 110 located approximately at a mid-height location (that is, the gripping surface 110 is centered at about half-way along a height (or length) dimension of the first cylinder 112). A second cylinder 114 may include a gripping surface 110 located proximate one end of the second cylinder 114. A third cylinder 116 may include a gripping surface 110 located at the very top (or very bottom). In the embodiment of FIG. 5, the third cylinder 116 may be a driven cylinder and may include a chain 122 (or belt) wrapping around the third cylinder 116 with first and second ends 118, 120 of the roller chain 122 (or belt) extending back to a primary or secondary shaft 70, 72 (shown in FIG. 2) in order to rotate the new pipe 30 and other components of the system. The chain 112 may include notches, cogs, spokes, grooves, gears, spurs, sprockets, divots, teeth, bumps, trenches, roughened surfaces, grip surfaces, and other mechanisms, as described above. The cylinders 112, 114, 116 as well as the new pipe 30 may each include multiple gripping surfaces 110. In other embodiments, the cylinders 112, 114, 116 as well as the new pipe 30 may each include gripping surfaces 110 that cover the entire external substrates. In other embodiments, cylinders 112, 114, 116 as well as the new pipe 30 may each include gripping surfaces 110 that are composed of a different material than the underlying respective substrates. In other embodiments, cylinders 112, 114, 116 as well as the new pipe 30 may each include gripping surfaces 110 that are composed of the same material as the underlying respective substrates. As discussed above, the differential iron roughneck 60 may include various numbers and sizes of cylinders 112, 114, 116.

Figure 6:
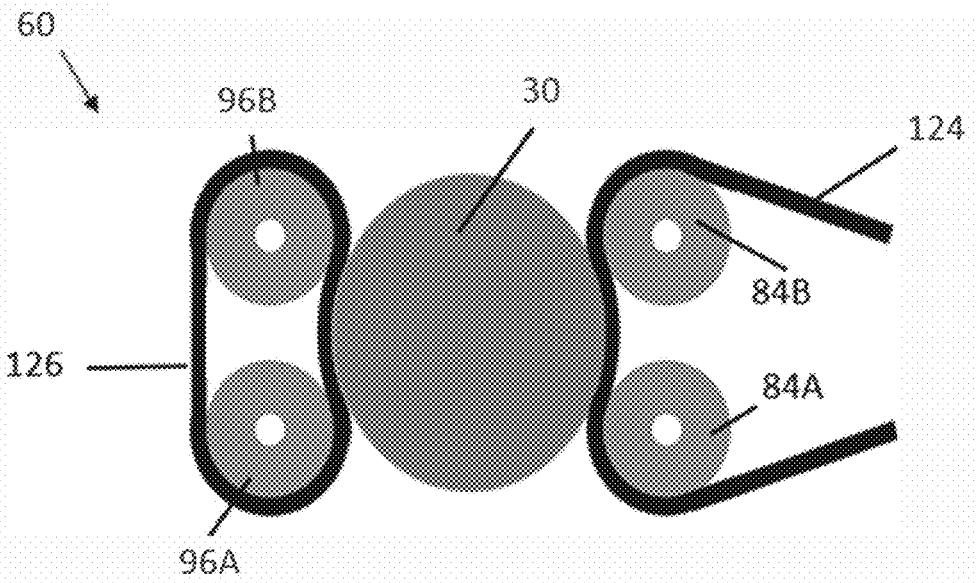
FIG. 6 illustrates a top view depiction of a differential roughneck, according to the present embodiments.

FIG. 6 illustrates a top view of a portion of the differential iron roughneck 60 according to aspects of the present disclosed embodiments. The differential iron roughneck 60 includes first and second gripping cylinders 84A, 84B (which are driven via the secondary shaft 72 and differential gearbox 66, shown in FIG. 2), as well as first and second balancing cylinders 96A, 96B, all disposed around (and interfacing with) the new pipe 30 or drill pipe being attached to the drill string 42 (shown in FIG. 2). In the embodiment of FIG. 6, the differential iron roughneck 60 includes roller chains 124, 126 for forming the interface between the gripping and balancing cylinders 84A, 84B, 96A, 96B and the new pipe 30. A first roller chain 124 may wrap around the first and second gripping cylinders 84A, 84B and connect to the primary or secondary shaft 70, 72, thereby allowing the first and second gripping cylinders 84A, 84B to be driven. The first roller chain 124 may also form the interface between the first and second gripping cylinders 84A, 84B and the new pipe 30, allowing for the transfer of torque to the new pipe 30. The differential iron roughneck 60 may also include a second roller chain 126 that wraps around the first and second balancing cylinders 96A, 96B, allowing them to rotate in concert with the rotation of the new pipe 30, while simultaneously allowing them to exert one or more balancing forces on the new pipe 30, to counteract the forces acting on the new pipe 30 from the first and second gripping cylinders 84A, 84B. Each of the interfacing surfaces (that is, "interfacing surface" in the sense that it contacts at least one of the roller chains 124, 126) on the gripping and balancing cylinders 84A, 84B, 96A, 96B as well as the new pipe 30 may include notches, cogs, spokes, grooves, gears, spurs, sprockets, divots, teeth, bumps, dimples, trenches, roughened surfaces, grip surfaces, as well as other mechanisms for allowing the roller chains 124, 126 to grip the interfacing surface.

Figure 7:
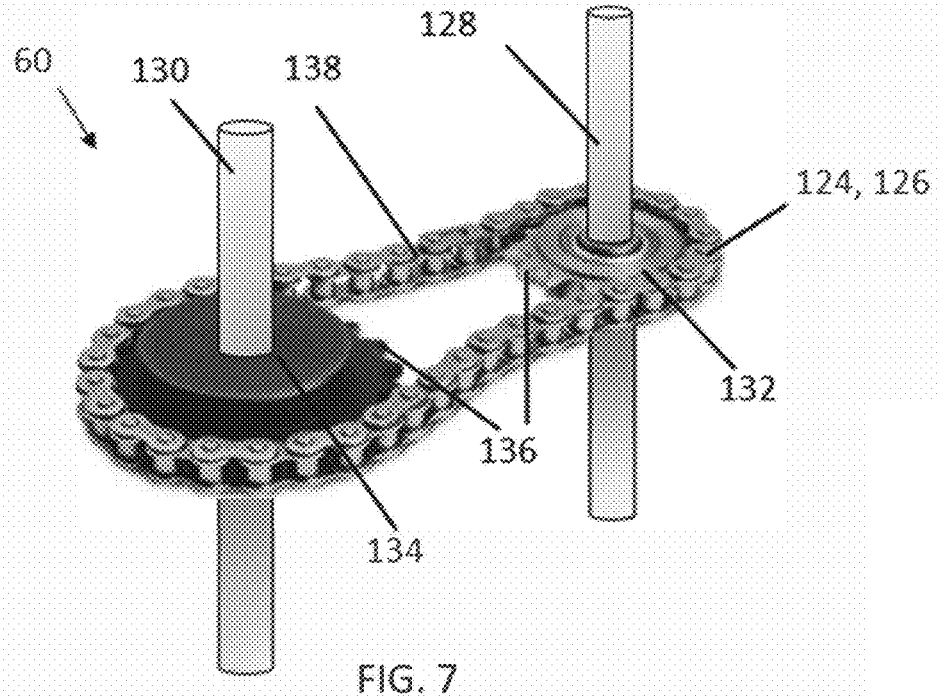
FIG. 7 illustrates a prespective view depiction of a differential roughneck, according to the present embodiments.

FIG. 7 illustrates a perspective view of a portion of the differential iron roughneck 60 according to aspects of the present disclosed embodiments. The differential iron roughneck 60 includes an illustration depicting how a roller chain 124, 126 may transfer torque from a first cylinder 128 to a second cylinder 130 in a roughneck system. Each of the first and second cylinders 128, 130 may include respective first and second hubs 132, 134, about which the roller chain 124, 126 is wrapped. The first and second hubs 132, 134 may include one or more first interfacing features 136 which may include notches, cogs, spokes, grooves, gears, spurs, sprockets, divots, teeth, bumps, dimples, trenches, roughened surfaces, grip surfaces, as well as other mechanisms. Similarly, the roller chain 124, 126 may include one or more second interfacing features 138 corresponding to the hub features. The one or more interfacing features may include notches, cogs, spokes, grooves, gears, spurs, sprockets, divots, teeth, bumps, dimples, trenches, roughened surfaces, grip surfaces, as well as other mechanisms. In some embodiments, the first and second hubs 132, 134 and first interfacing features 136 may be separate components into which the first and second cylinders 128, 130 may be disposed (for example, via epoxy, glue, adhesion, fusion, compression fit, as well as other attachment mechanisms). In other embodiments, the first and second hubs 132, 134 and first interfacing features 136 may be integral with the first and second cylinders 128, 130 (that is, they are features of the first and second hubs 132, 134 rather than separate components).

The embodiments of each of FIGS. 4-7 may also include the other components illustrated in FIGS. 1-3 and discussed previously.

FIG. 8 illustrates a method 800 of making or breaking a drill string 42 connection using a differential iron roughneck 60, while allowing the drill string 42 to continuously rotate. At step 802, the method 800 may include hanging the drill string 42 on the rotary table 56. At step 804, the method may include rotating the drill string through the rotary table. At step 806, the method 800 may include aligning the new pipe 30 with the drill string 42. At step 808, the method 800 may include engaging the differential gearbox 66 via the drive shaft 68, which may include introducing torque to the differential gearbox 66 via the drive shaft 68, thereby causing the cage within the differential gearbox 60, along with the primary and secondary shafts 70, 72 to begin spinning. At step 810, the method 800 may include causing the differential iron roughneck 60 to be engaged on the new pipe 30 and drill string 42. Step 810 may include bringing the driven portion 62 and balancing portion 64 of the differential roughneck 60 proximate the new pipe 30 and drill string 42, and then securing the driven and balancing portions 62, 64 into place (for example via tightening screws disposed in the arms 86, 88, 90, 92, 98, 100, 102, 104) such that each of the driven and balancing portions 62, 64 exerts contact force onto the new pipe 30 and drill string 42 (that is, via the dripping and balancing cylinders 78, 84, 94, 96).

Referring still to FIG. 8, at step 812, the method 800 may include engaging the pin 106 with the box 108 such that the respective male and female threads align and begin to engage one another. At step 814, the method 800 may include applying the requisite make-up torque onto the drill-string 42 and new pipe 30 via the differential iron roughneck 60. At step 816, the method 800 may include disengaging the differential iron roughneck 60 after the connection has been established. At step 818, the method 800 may include stopping the rotation of the rotary table 56 in order to pick up the drill string 42. At step 820, the method 800 may include resuming drilling operations with the newly-lengthened drill string 42 (that is, the drill string 42 including the new pipe 30 that has just been connected).

Still referring to FIG. 8, at step 822, the method 800 may include repeating steps 802-820 as many times as is needed during the drilling operation. For example, as the borehole continues to get deeper and the drill string 42 continues to need lengthening, additional drill pipes (that is, new pipes 30) may be connected to the drill string 42 following steps 802-820, while continuing to keep the drill string 42 rotating. Steps 824-840 describe a disassembly sub-process of the method 800. At step 824, the method 800 may include hanging the new pipe 30 on the rotary table 56. At step 826, the method 800 may include initiating rotation through the rotary table 56. At step 828, the method 800 may include aligning the differential iron roughneck 60 with the new pipe 30 and the drill string 42. At step 830, the method 800 may include causing the differential iron roughneck 60 to be engaged on the new pipe 30 and drill string 42. As discussed with respect to step 810, step 830 may also include bringing the driven portion 62 and balancing portion 64 of the differential iron roughneck 60 proximate the new pipe 30 and drill string 42, and then securing the driven and balancing portions 62, 64 into place (for example via tightening screws disposed in the arms 86, 88, 90, 92, 98, 100, 102, 104) such that each of the driven and balancing portions 62, 64 exerts contact force onto the new pipe 30 and drill string 42 (that is, via the gripping and balancing cylinders 78, 84, 94, 96).

Referring still to FIG. 8, at step 832, the method 800 may include applying a resistive torque to the new pipe 30. The resistive torque may gradually be applied. Once the resistive torque applied to the new pipe 30 matches or exceeds a break-up torque, the new pipe 30 will begin to disengage from the drill string 42. At step 834, the method 800 may include disengaging the pin 106 from the box 108. At step 836, the method 800 may include disengaging the differential iron roughneck 60 (as previously discussed with respect to step 818). At step 838, the method 800 may include stopping the rotation of the rotary table 56 in order to pick up the slips and/or new drill pipe 30 (as previously discussed with respect to step 818). At step 840, the method 800 may include repeating steps 824-838 as many times as needed to partially or fully disassemble the drill string 42. According to aspects of the present disclosed embodiments, method 800 may also include other steps as well as performing steps 802-840 in a different order than what is illustrated in FIG. 8. For example, if a new pipe 30 (or drill pipe) becomes damaged, it may be necessary to partially disassemble the drill string 42 (via steps 824-840) to remove the damaged portion, then reassemble the drill string 42 (via 802-822) in order to resume drilling operations. In some embodiments of the present disclosure, one or more steps of method 800 may be omitted.

By employing a differential roughneck 60 to make and break drill pipe connections to the drill string 42, the present embodiments allow the drill string 42 to achieve continuous rotation of the drill string 42 throughout the entire process. The differential iron roughneck 60 may be mechanically coupled to both the drill string 42 and the new pipe 30 while delivering make up torque to the new pipe 30 and allowing them to rotate at different speeds, which allows a connection to be made or broken while keeping the entire system rotating. The present embodiments help to minimize the risk of the drill string 42 getting stuck in the borehole during the processes of making and breaking a connection.

These and other features, aspects and advantages of the present invention will become better understood with reference to the following description and appended claims. The accompanying drawings, which are incorporated in and constitute a part of this specification, illustrate embodiments of the present disclosure and, together with the description, serve to explain the principles of the present embodiments.

Certain Definitions

In order for the present disclosure to be more readily understood, certain terms are first defined below. Additional definitions for the following terms and other terms are set forth throughout the specification.

An apparatus, composition, or method described herein as "comprising" one or more named elements or steps is open-ended, meaning that the named elements or steps are essential, but other elements or steps may be added within the scope of the composition or method. To avoid prolixity, it is also understood that any apparatus, composition, or method described as "comprising" (or which "comprises") one or more named elements or steps also describes the corresponding, more limited composition or method "consisting essentially of" (or which "consists essentially of") the same named elements or steps, meaning that the composition or method includes the named essential elements or steps and may also include additional elements or steps that do not materially affect the basic and novel characteristic(s) of the composition or method. It is also understood that any apparatus, composition, or method described herein as "comprising" or "consisting essentially of" one or more named elements or steps also describes the corresponding, more limited, and closed-ended composition or method "consisting of" (or "consists of") the named elements or steps to the exclusion of any other unnamed element or step. In any composition or method disclosed herein, known or disclosed equivalents of any named essential element or step may be substituted for that element or step.

As used herein, the term "differential iron roughneck" refers to any iron roughneck or system for making and breaking pipe connection employing a differential gearbox.

As used herein, the term "substantially" refers to the qualitative condition of exhibiting total or near-total extent or degree of a characteristic or property of interest.

Equivalents

It is to be understood that while the disclosure has been described in conjunction with the detailed description thereof, the foregoing description is intended to illustrate and not limit the scope of the invention(s). Other aspects, advantages, and modifications are within the scope of the claims.

This written description uses examples to disclose the invention, including the best mode, and also to enable any person skilled in the art to practice the present embodiments, including making and using any devices or systems and performing any incorporated methods. The patentable scope of the present embodiments is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A differential iron roughneck for making or breaking a pipe connection comprising:

at least one first gripping cylinder for delivering torque to a first pipe;

at least one second gripping cylinder for delivering and receiving torque to and from a second pipe;

a differential gearbox comprising:

a primary shaft delivering torque to the at least one first gripping cylinder; and a secondary shaft receiving torque from the at least one second gripping cylinder; and a driven portion comprising:

a first pair of arms, the first pair of arms extending laterally and comprising a first axle extending therebetween, the first axle concentrically disposed within the at least one first gripping cylinder; and a second pair of arms, the second pair of arms extending laterally and comprising a second axle extending therebetween, the second axle concentrically disposed within the at least one second gripping cylinder, where the primary shaft and the secondary shaft rotate at different speeds.

2. The differential iron roughneck of claim 1, further comprising:

at least one first balance cylinder for contacting the first pipe, the at least one first balance cylinder comprising a first centerline axis; and at least one second balance cylinder for contacting the second pipe, the at least one second balance cylinder comprising a second centerline axis, where the at least one first balance cylinder and the at least one second balance cylinder freely spin about the respective first and second centerline axes.

3. The differential iron roughneck of claim 2, where the at least one first balance cylinder exerts a first force on the first pipe which balances a second force exerted by the first gripping cylinder on the first pipe.

4. The differential iron roughneck of claim 1 further comprising:

at least two first gripping cylinders; and at least two second gripping cylinders.

5. The differential iron roughneck of claim 2 further comprising:

at least two first balance cylinders; and at least two second balance cylinders.

6. The differential iron roughneck of claim 1, the differential gearbox further comprising:

at least one drive shaft, the at least one drive shaft introducing a driving torque into the differential gearbox for rotating both the primary shaft and the secondary shaft.

7. The differential iron roughneck of claim 1, further comprising:

at least one of a first roller chain and a first belt coupling the first gripping cylinder to the primary shaft; and at least one of a second roller chain and a second belt coupling the second gripping cylinder to the secondary shaft.

8. The differential iron roughneck of claim 2, where at least one of the first gripping cylinder, the second gripping cylinder, the first balance cylinder, and the second balance cylinder further comprises at least one gripping surface.

9. A system for making or breaking a pipe connection comprising:

a first pipe;

a second pipe; and a differential iron roughneck comprising:

at least one first gripping cylinder for delivering torque to the first pipe;

at least one second gripping cylinder for delivering torque to a second pipe; and a differential gearbox coupled to each of the at least one first gripping cylinder and the at least one second gripping cylinder, and a balance portion comprising:

at least one first balance cylinder for contacting the first pipe, the at least one first balance cylinder comprising a first centerline axis;

at least one second balance cylinder for contacting the second pipe, the at least one second balance cylinder comprising a second centerline axis;

a first pair of balance arms, the first pair of balance arms extending laterally and comprising a first balance axle extending therebetween, the first balance axle concentrically disposed within the at least one first balance cylinder; and a second pair of balance arms, the second pair of balance arms extending laterally and comprising a second balance axle extending therebetween, the second balance axle concentrically disposed within the at least one second balance cylinder, where the differential gearbox rotates the at least one first gripping cylinder and the at least one second gripping cylinder at different speeds.

10. The system of claim 9, where the first pipe is the top pipe of a drill string, and where the second pipe comprises a drill pipe to be added to the drill string.

11. The system of claim 9, where the first pipe comprises a box portion, the box portion comprising female threading, and where the second pipe comprises a pin portion, the pin portion comprising male threading for engaging with the female threading of the box portion during at least one of making the pipe connection and breaking the pipe connection.

12. The system of claim 10, further comprising a rotary table coupled to the drill string.

13. The system of claim 9, further comprising a swivel coupled to the second pipe, the swivel vertically supporting the second pipe and allowing the second pipe to rotate.

14. The system of claim 10, the drill string comprising a drill bit.

15. A method of making a pipe connection comprising:

providing a differential iron roughneck, the differential iron roughneck comprising at least one differential gearbox comprising a primary shaft and a secondary shaft;

engaging a drill string with the differential iron roughneck; and engaging a second pipe with the differential iron roughneck, the second pipe to be added to the drill string, where the primary shaft is coupled to the drill string and rotates the drill string, where the secondary shaft is coupled to the second pipe and rotates the second pipe faster than the drill string, and where the primary shaft is disposed between the differential gearbox and a primary bearing, and where the secondary shaft is disposed between the differential gear box and a secondary bearing.

16. The method of claim 15, further comprising:

aligning the second pipe with the drill string,. where a crown block is disposed at a fixed location at the top of a derrick, while a traveling block is disposed beneath the crown block.

17. The method of claim 15, further comprising:

engaging at least one female thread disposed in the drill string with at least one male thread disposed in the second pipe, where a mud pump is positioned on the a ground surface or on a rig floor, and where the mud pump is used to at least one of pump mud, slurries and drilling fluid through a mud hose to a drill string inlet located at the top of the second pipe.

18. The method of claim 15, further comprising:

disengaging the drill string from a rotary table, where the differential iron roughneck is integrated into a rotary table of an existing rig.

19. The method of claim 15, where the differential iron roughneck simultaneously engages both the second pipe and drill string as it beings to spin.

20. The method of claim 15, where the differential gearbox further comprises at least one drive shaft, the at least one drive shaft introducing a driving torque into the differential gearbox for rotating both the primary shaft and the secondary shaft, where the drive shaft is oriented at approximately a right angle to a drive chain, and where the angle is from about +/−5 to about +/−10 degrees.

* * * * *